US005941262A

United States Patent [19]

Tschirhart

[11] Patent Number: 5,941,262

[45] Date of Patent: Aug. 24, 1999

[54] STEP ASSISTING DEVICE

[76] Inventor: Regan Tschirhart, 423 Westwood Dr #9, Kitchener Ontario, Canada, N2M 5B5

[21] Appl. No.: 09/054,249

[22] Filed: Apr. 2, 1998

[51] Int. Cl.[6] ..... A45B 1/00

[52] U.S. Cl. ..... 135/65; 135/77; D3/9

[58] Field of Search ..... D3/9, 17; 135/65–67, 135/75–77, 81, 910, 911

[56] References Cited

U.S. PATENT DOCUMENTS

| | | | |
|---|---|---|---|
| D. 324,946 | 3/1992 | Karten | D3/17 |
| D. 329,538 | 9/1992 | Rau | D3/9 |
| 4,044,784 | 8/1977 | Smith | 135/67 |
| 4,091,828 | 5/1978 | Jorgensen | 135/66 |
| 4,258,735 | 3/1981 | Meade | 135/65 |
| 4,274,430 | 6/1981 | Schaaf et al. | 135/65 |
| 4,997,001 | 3/1991 | DiCarlo | 135/65 |
| 5,238,013 | 8/1993 | Battiston et al. | 135/75 |
| 5,307,828 | 5/1994 | Gardner et al. | 135/82 |
| 5,318,057 | 6/1994 | Wallum | 135/65 |
| 5,385,163 | 1/1995 | Fairchild | 135/65 |
| 5,390,687 | 2/1995 | Tsai | 135/65 |
| 5,499,645 | 3/1996 | Baliga | 135/67 |
| 5,794,638 | 8/1998 | Rivhey | 135/65 |

*Primary Examiner*—Beth A. Aubrey

[57] ABSTRACT

A new step assisting device for assisting a person in ascending or descending stairs or steps. The inventive device includes an adjustable size support base including first and second base portions adjustably secured to each other. First and second support feet are connected to the first base portion and the second base portion and are adjustable relative thereto in order to adjust the height of the support base. An adjustable handle is pivotally attached to the support base in order to make it easier to use the device, and the handle is biased by a spring to a generally vertical position.

12 Claims, 2 Drawing Sheets

FIG. 1
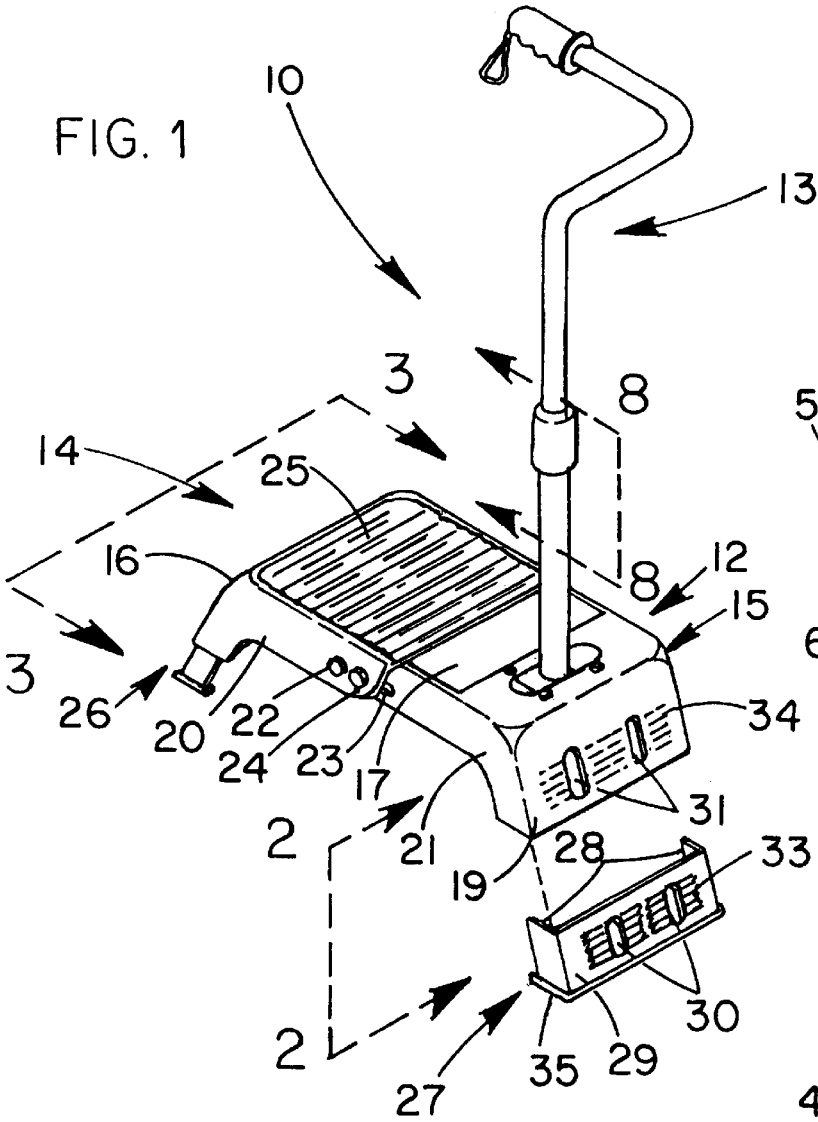
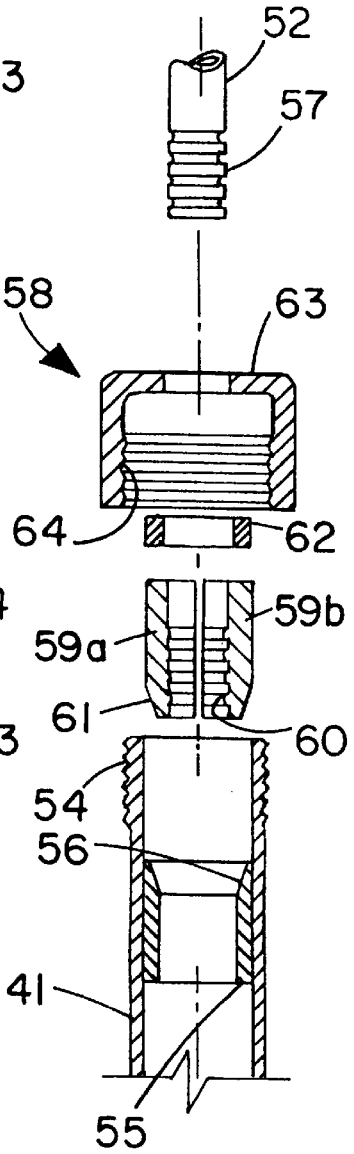
FIG. 8
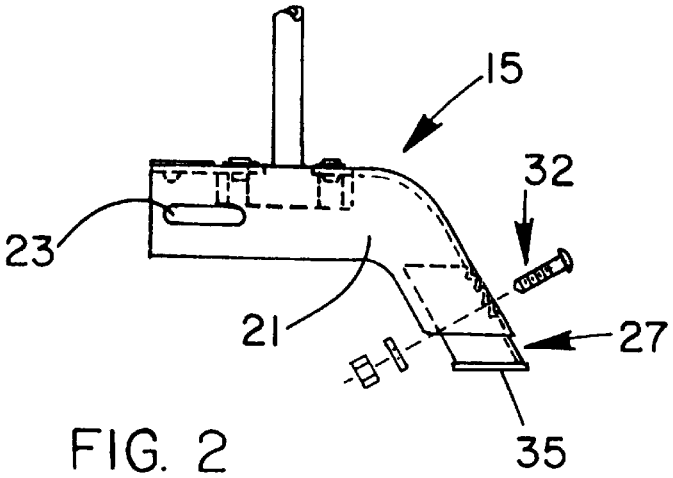
FIG. 2

STEP ASSISTING DEVICE

BACKGROUND OF THE INVENTION

1. Field of the Invention

The present invention relates to step canes, and more particularly pertains to a new step assisting device for assisting a person in ascending or descending stairs or steps.

2. Description of the Prior Art

The use of step canes is known in the prior art. More specifically, step canes heretofore devised and utilized are known to consist basically of familiar, expected and obvious structural configurations, notwithstanding the myriad of designs encompassed by the crowded prior art which have been developed for the fulfillment of countless objectives and requirements.

Known prior art step canes include U.S. Pat. No. 5,318,057; U.S. Pat. No. 5,385,163; U.S. Pat. No. 4,258,735; U.S. Pat. No. 4,274,430; U.S. Pat. No. Des. 324,946; and U.S. Pat. No. 4,091,828.

While these devices fulfill their respective, particular objectives and requirements, the aforementioned patents do not disclose a new step assisting device. The inventive device includes an adjustable size support base including first and second base portions adjustably secured to each other. First and second support feet are connected to the first base portion and the second base portion and are adjustable relative thereto in order to adjust the height of the support base. An adjustable handle is pivotally attached to the support base in order to make it easier to use the device, and the handle is biased by a spring to a generally vertical position.

In these respects, the step assisting device according to the present invention substantially departs from the conventional concepts and designs of the prior art, and in so doing provides an apparatus primarily developed for the purpose of assisting a person in ascending or descending stairs or steps.

SUMMARY OF THE INVENTION

In view of the foregoing disadvantages inherent in the known types of step canes now present in the prior art, the present invention provides a new step assisting device wherein the same can be utilized for assisting a person in ascending or descending stairs or steps.

The general purpose of the present invention, which will be described subsequently in greater detail, is to provide a new step assisting device which has many of the advantages of the step canes mentioned heretofore and many novel features that result in a new step assisting device which is not anticipated, rendered obvious, suggested, or even implied by any of the prior art step canes, either alone or in any combination thereof.

To attain this, the present invention generally comprises an adjustable size support base including first and second base portions adjustably secured to each other. First and second support feet are connected to the first base portion and the second base portion and are adjustable relative thereto in order to adjust the height of the support base. An adjustable handle is pivotally attached to the support base in order to make it easier to use the device, and the handle is biased by a spring to a generally vertical position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new step assisting device which has many of the advantages of the step canes mentioned heretofore and many novel features that result in a new step assisting device which is not anticipated, rendered obvious, suggested, or even implied by any of the prior art step canes, either alone or in any combination thereof.

It is another object of the present invention to provide a new step assisting device which may be easily and efficiently manufactured and marketed.

It is a further object of the present invention to provide a new step assisting device which is of a durable and reliable construction.

An even further object of the present invention is to provide a new step assisting device which is susceptible of a low cost of manufacture with regard to both materials and labor, and which accordingly is then susceptible of low prices of sale to the consuming public, thereby making such step assisting device economically available to the buying public.

Still yet another object of the present invention is to provide a new step assisting device which provides in the apparatuses and methods of the prior art some of the advantages thereof, while simultaneously overcoming some of the disadvantages normally associated therewith.

Still another object of the present invention is to provide a new step assisting device for assisting a person in ascending or descending stairs or steps.

Yet another object of the present invention is to provide a new step assisting device which includes an adjustable size support base including first and second base portions adjustably secured to each other. First and second support feet are connected to the first base portion and the second base portion and are adjustable relative thereto in order to adjust the height of the support base. An adjustable handle is pivotally attached to the support base in order to make it easier to use the device, and the handle is biased by a spring to a generally vertical position.

Still yet another object of the present invention is to provide a new step assisting device that is adjustable to tailor the device to the individual user and to the height of the steps or stairs normally encountered by the user.

Even still another object of the present invention is to provide a new step assisting device that instills self-confidence by permitting the user to have access to more areas of his/her house.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an elevated side perspective view of a new step assisting device according to the present invention.

FIG. 2 is a view looking generally in the direction of line 2—2 of FIG. 1.

FIG. 8 is a cross sectional view taken along line 8—8 of FIG. 1.

DESCRIPTION OF THE PREFERRED EMBODIMENT

Figure 3:
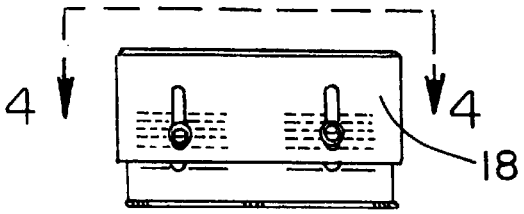
FIG. 3 is a view looking generally in the direction of line 3—3 of FIG. 1.
Figure 4:
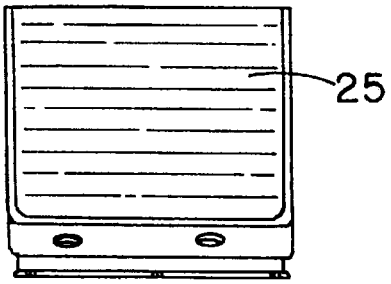
FIG. 4 is a view looking generally in the direction of line 4—4 of FIG. 3.
Figure 7:
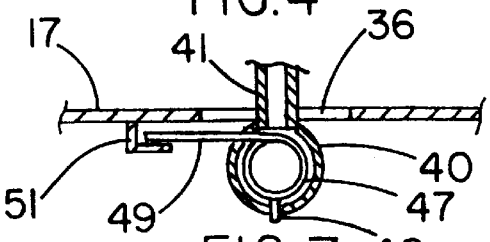
FIG. 7 is a cross sectional view taken along line 7—7 of FIG. 6.
Figure 6:
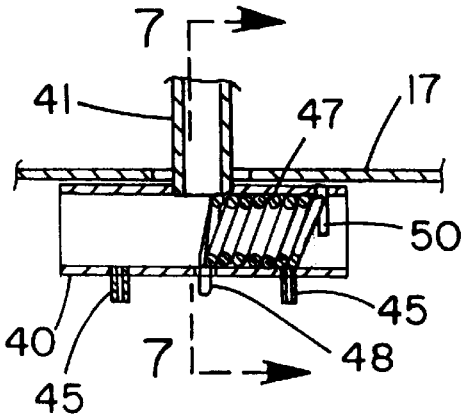
FIG. 6 is a cross sectional view taken along line 6—6 of FIG. 5.

With reference now to the drawings, and in particular to FIGS. 1 through 8 thereof, a new step assisting device embodying the principles and concepts of the present invention and generally designated by the reference numeral 10 will be described.

As best illustrated in FIGS. 1 through 8, the step assisting device 10 comprises a support base 12 and a handle 13 connected to the support base.

The support base 12 defines a generally rectangular platform upon which a person stands with one foot while ascending or descending stairs or steps. The base 12 is adjustable in area and height to accommodate different users and different stair/step heights. As shown in FIG. 1, the base 12 includes first and second base portions 14,15 which are connected to each other in a manner permitting adjustment of the portions 14,15 relative to each other. Each portion 14,15 includes a substantially planar top plate 16,17 defining substantially planar surfaces, end plates 18,19 extending at an angle downward from the top plates 16,17, and side flanges 20,21 extending from each side of the top plates 16,17 and end plates 18,19.

The base portion 14 overlaps the base portion 15 such that the top plate 16 and side flanges 20 overlap the top plate 17 and the side flanges 21. Each side flange 20 includes a pair of spaced holes 22 therethrough, while each side flange 21 includes an elongated slot 23 formed therein which is aligned with the holes 22. A fastener 24, such as a bolt or the like, is disposed through at least one of the holes 22 in each side flange 20 and through the slot 23 in each side flange 21, and is secured on the inside of the side flanges 21 by a nut or the like (not shown). Thus by loosening the fastener 24, the base portion 14 can either be moved away from, or toward, the base portion 15 to increase or decrease the platform area of the support base 12, limited only by the length of the slots 23. The fastener 24 is then tightened to secure the base portions 14,15 together. Any type of fastener 24 can be used, as long as it is able to be selectively tightened and loosened in order to permit adjustment of the base portions 14,15 relative to each other.

The first base portion 14 further includes a non-slip covering 25 of rubber, or the like, attached to the top plate 16, in order to prevent a users foot from slipping while standing on the device. The covering 25 can be corrugated or provided with other surface roughening in order to increase the friction between the users foot and the covering 25. The top plate 17 could also be provided with a non-slip covering if so desired to prevent slipping if the user places his foot on the top plate 17.

First and second adjustable support feet 26,27 are connected to the first and second base portions 14,15, respectively, in order to permit adjustment of the height of the support base 12, thus allowing the device to be adjusted to different stair/step heights. The support feet 26,27, and their adjustment, are identical to each other, so only one will be described in detail.

Referring to FIGS. 1 and 2, the foot 27 is received between the side flanges 21 of the base portion 15, and includes side flanges 28 connected to an end wall 29. A pair of elongated apertures 30 are formed through the end wall 29. The end plate 19 of the base portion 15 also includes a pair of elongated apertures 31 which are aligned with the apertures 30. A nut and bolt assembly 32 is disposed through each of the aligned apertures 30,31 in order to secure the foot 27 to the base portion 15 and permit its adjustment relative thereto. In order to improve the connection between the foot 27 and the base portion 15, a plurality of spaced indexing notches 33 are formed in the end wall 29 on each side of the apertures 30, which engage with spaced indexing notches 34 (shown in dashed lines in FIG. 1) formed on the inside of the end plate 19 on each side of the holes 31. Thus, by engaging the notches 33 with the notches 34, a more positive and secure connection between the foot and base portion is obtained so that the foot is prevented from inadvertent movements when the nut and bolt assemblies 32 are tightened. A non-slip material 35 of rubber, or the like, is attached to the bottom surface of the foot 27 to prevent the foot from slipping relative to an underlying support surface and to prevent marring of the support surface.

Figure 5:
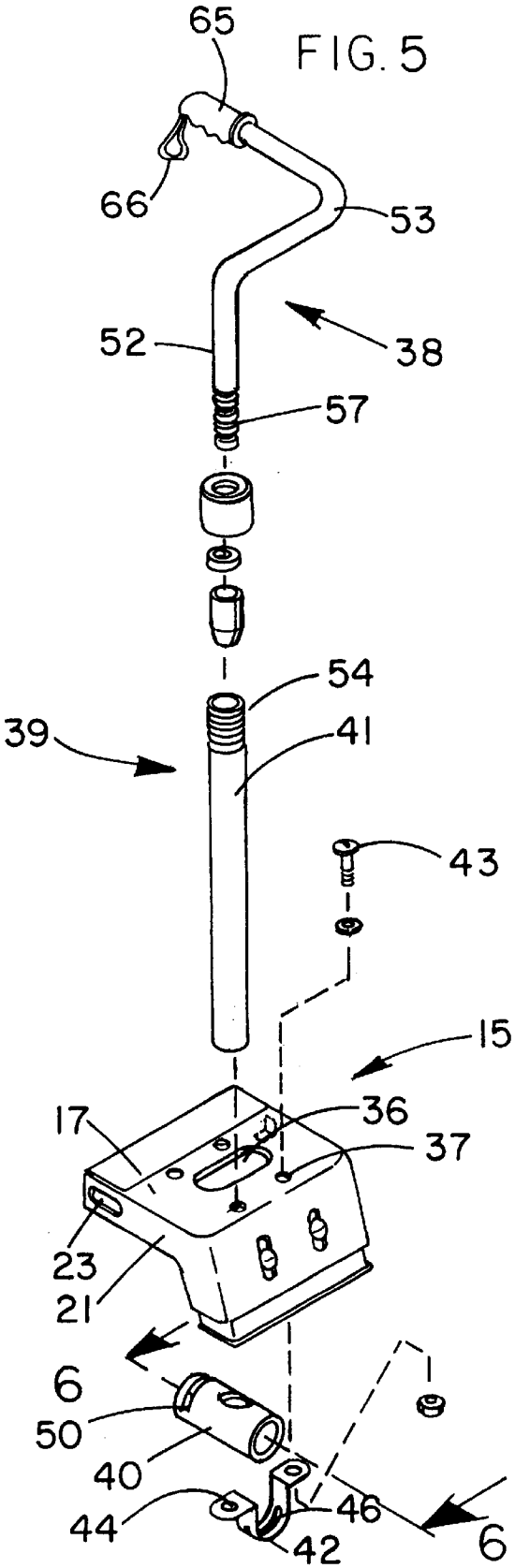
FIG. 5 is an exploded view of the handle and its connection to the support base.

The handle 13, as best shown in FIGS. 1, 2, and 5, is pivotally connected to the second base portion 15. The top plate 17 of the base portion 15 includes an elongated slot 36 formed therethrough, with spaced holes 37 formed on each side of the slot 36. The handle 13 comprises upper 38 and lower 39 handle portions. The lower handle portion 39 includes a cylindrical sleeve 40 which is rotationally supported within the base portion 15 and is orthogonally disposed relative to the longitudinal axis of the slot 36, and a stem portion 41 integrally connected to the sleeve 40 and extending perpendicularly therefrom. The sleeve 40 is supported by a pair of brackets 42 which are disposed underneath the sleeve and which are connected to the top plate 17 by suitable threaded nut and bolt assemblies which include a threaded fastener 43 extending through apertures 44 provided the brackets 42 and into the holes 37 and secured in place with nuts. Thus the sleeve 40 is pivotally secured to the base portion 15, and retained therein, by the brackets 42 which support the bottom of the sleeve, so as to permit pivoting of the sleeve, and thus the rest of the handle 13, relative to the base portion 15. Since the longitudinal axis of the sleeve is perpendicular to the longitudinal axis of the slot 36, the sleeve cannot be vertically removed through the slot absent a 90 degree rotation of the sleeve to align the axes of the sleeve and the slot.

The sleeve 40 further includes a pair of projections 45 extending from the bottom thereof which are disposed within slots 46 formed in the brackets 42 so as to effectively limit the range of pivoting movement of the sleeve, and therefore the handle, by contact between the projections and the ends of the slots 46. Further, the sleeve 40 includes a biasing spring 47 disposed in the interior thereof for biasing the handle to a generally vertical position relative to the support base 12. The spring 47 includes a first end 48 which is fixed to the sleeve, and a second end 49 which extends through a slot 50 formed through the sleeve 40 and which engages within a projection 51 extending down from the inside of the top plate 17. The arrangement of the spring 47 is such as to bias the handle 13 to the vertical position if the handle is pivoted away from such an orientation. The sleeve 40 rotates relative to the spring 47 during its pivoting movements, facilitated by the slot 50.

As stated previously, the stem portion 41 is fixedly attached to, and extends from, the sleeve 40. The upper handle portion 38, on the other hand, includes a vertical stem portion 52 and a right angled horizontal gripping portion 53 integral with the portion 52. The stem portions 41,52 are connected together in a manner which permits both vertical and angular adjustments of the upper handle portion 38 relative to the lower handle portion 39.

Referring to FIGS. 5 and 8, it is seen that the upper end of the stem portion 41 is tubular and is threaded as at 54. Also, a resilient, cylindrical wedge member 55 is fixed within the upper end of the tubular stem portion 41. The member 55 includes a tapered receiving end 56, the purpose of which will become later apparent. The lower end of the stem portion 52 also includes spaced grooves 57 thereon, for engagement with a locking mechanism 58 to secure the stem portion 52 to the stem portion 41.

The locking mechanism 58 comprises locking wedges 59*a,b* which include internal notches 60 for mating with the grooves 57 on the stem portion 52. The wedges 59*a,b* each include a tapered end 61 which engage with the tapered end 56 of the member 55 to force the wedges radially inward. A spacing washer 62 is disposed over the stem portion 52 and is disposed on top of the wedges 59*a,b,* and a locking nut 63 which includes an internal thread 64 for mating with the thread 54 is disposed over the stem portion 52 and engages with the stem portion 41. In use, the wedges 59*a,b* are disposed on opposite sides of the grooves 57 of the stem portion 52. As the nut 63 is screwed down, it pushes the washer 62 downward, which forces the wedges 59*a,b* downward. The tapers 61 engage the taper 56, forcing the wedges radially inward so as to clamp the stem portion therebetween and preventing both vertical adjustment and rotational adjustment. In order to adjust either the height of the handle 13, or the rotational position of the upper handle relative to the lower handle, the nut 63 is loosened thus releasing the clamping force of the wedges. The stem portion 52 can then be moved either up or down and/or rotated relative to the stem portion 41, with the grooves 57 engaging in different notches 60. The nut 63 is then retightened to lock the upper handle and lower handle.

The right-angled gripping portion 53 is configured so that it is not substantially disposed over the top plates 16,17, thus permitting the user to easily step onto the non-slip covering 25 without obstruction from the handle. A hand grip 65 with a looped strap 66 attached thereto is disposed on the end of the portion 53 to provide a comfortable grip for the user.

When using the device, the user places the device on the same step or surface upon which he or she is standing. While gripping the hand grip 65 or any other portion of the handle 13, the user steps onto the top plate 16 and the covering 25 attached thereto with one foot. The user then moves the opposite foot to the tread of the next adjacent step. This process is repeated until the user reaches the top or bottom of the stair or steps. The pivoting handle 13 accommodates movements of the user, while the adjusting features of the handle 13 permits the device to be adjusted to the size of the user. If the user encounters steps having a different height from that normally encountered, the feet can be adjusted up or down so that the height of the support base 12 is approximately one-half of the step height. The size of the support base 12 can also be adjusted by loosening the fasteners 24 and adjusting the base portions 14,15 relative to each other, so as to accommodate different step widths and different user sizes.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A device for assisting a person in traveling up and down stairs, comprising:

an adjustable size support base including first and second base portions, means for connecting the first base portion and the second base portion to each other in order to permit adjustment of the first base portion and the second base portion relative to each other so as to adjust the size of the support base;

a first support foot releasably connected to the first base portion and a second support foot releasably connected to the second base portion, said first and second support feet adapted for supporting the support base upon a supporting surface; and a handle pivotally attached to the support base, and means for biasing the handle to a generally perpendicular position relative to the support base.

2. The device according to claim 1, wherein said first base portion includes an upper, substantially planar surface, and a non-slip material secured to the planar surface.

3. The device according to claim 1, wherein said first support foot is adjustable relative to said first base portion, and said second support foot is adjustable relative to said second base portion.

4. The device according to claim 1, wherein said first and second support feet each include a bottom surface, and a non-slip material secured to each said bottom surface.

5. The device according to claim 1, wherein said handle is pivotally attached to the second base portion of the support base.

6. The device according to claim 1, wherein said biasing means comprises a spring.

7. The device according to claim 1, wherein said handle comprises a lower handle portion pivotally connected to the second base portion and an upper handle portion releasably connected to the lower handle portion in a manner which permits adjustment of the upper handle portion relative to the lower handle portion.

8. The device according to claim 7, wherein said upper handle portion is longitudinally adjustable and rotationally adjustable relative to the lower handle portion.

9. The device according to claim 8, wherein said upper handle portion comprises a stem portion and a gripping portion, said stem portion being at least partially telescoped within said lower handle portion and being longitudinally adjustable relative thereto.

10. The device according to claim 7, wherein said lower handle portion comprises a cylindrical sleeve pivotally supported within the second base portion by support means, and a stem portion connected to the sleeve and extending perpendicularly therefrom.

11. The device according to claim 10, further comprising means for limiting the range of pivoting movements of the sleeve.

12. The device according to claim 11, wherein said limiting means comprises at least one projection extending from the sleeve and disposed within a slot formed in the support means.

* * * * *